US008707931B2

(12) United States Patent
Arima et al.

(10) Patent No.: US 8,707,931 B2
(45) Date of Patent: Apr. 29, 2014

(54) ENGINE SUPERCHARGING DEVICE

(75) Inventors: Hisatoyo Arima, Himeji (JP); Yoshinobu Tanaka, Hyogo (JP)

(73) Assignee: Kawasaki Jukogyo Kaubshiki Kaisha, Hyogo (JP)

( * ) Notice: Subject to any disclaimer, the term of this patent is extended or adjusted under 35 U.S.C. 154(b) by 62 days.

(21) Appl. No.: 13/441,750

(22) Filed: Apr. 6, 2012

(65) Prior Publication Data

US 2012/0192839 A1 Aug. 2, 2012

Related U.S. Application Data

(63) Continuation of application No. PCT/JP2010/067835, filed on Oct. 12, 2010.

(30) Foreign Application Priority Data

Oct. 14, 2009 (JP) ..... 2009-236996

(51) Int. Cl.

| | |
|---|---|
| ***F02M 51/00*** | (2006.01) |
| ***F02D 23/02*** | (2006.01) |
| ***F02M 35/10*** | (2006.01) |
| *F02M 51/06* | (2006.01) |

(52) U.S. Cl.

CPC ..... *F02D 23/02* (2013.01); *F02M 35/10157* (2013.01)

USPC ..... 123/478; 123/559.1

(58) Field of Classification Search

CPC ..... F02D 23/02; F02M 35/10157

USPC ..... 123/559.1, 316, 561, 564, 565, 445, 123/478; 701/103, 104

See application file for complete search history.

(56) References Cited

U.S. PATENT DOCUMENTS

| | | | | |
|---|---|---|---|---|
| 4,474,161 | A * | 10/1984 | Knapp et al. | 123/478 |
| 4,475,617 | A | 10/1984 | Minami et al. | |
| 4,763,636 | A * | 8/1988 | Tamura et al. | 123/564 |

(Continued)

FOREIGN PATENT DOCUMENTS

| | | |
|---|---|---|
| JP | 57-055223 | 4/1982 |
| JP | 01-232116 | 9/1989 |

(Continued)

OTHER PUBLICATIONS

PCT Application No. PCT/JP2010/067835 International Preliminary Report and Written Opinion dated May 24, 2012, 7 pages.

Chinese Patent Application No. 201080045699.3 Office Action dated Aug. 1, 2013 10 pages with partial English translation.

(Continued)

*Primary Examiner* — Mahmoud Gimie

(57) ABSTRACT

An engine supercharging device includes are a supercharger (38) for pressurizing air introduced in an engine (E), an air cleaner (36) for purifying an ambient air, a purified air supply passage (56) for supplying a purified air (CA) from the air cleaner (36) towards the supercharger (38), a supercharged air passage (62) for supplying the supercharged air (SA) from the supercharger (38) towards an air intake passage (60) of the engine (E), and a relief valve (68) for adjusting an air pressure within the supercharged air passage (62). The relief valve (68) has a discharge port portion (68*b*) which is accommodated within the air cleaner (36). The engine (E) has a plurality of engine cylinders, and a downstream portion of the supercharged air passage (62) is defined by an intake air chamber (54) for supplying the sucked air to respective air intake passages (60) of the plural engine cylinders.

12 Claims, 5 Drawing Sheets

(56) References Cited

U.S. PATENT DOCUMENTS

| | | | | | |
|---|---|---|---|---|---|
| 4,799,466 | A | * | 1/1989 | Shibata et al. | 123/327 |
| 4,932,368 | A | * | 6/1990 | Abe et al. | 123/470 |
| 5,003,957 | A | * | 4/1991 | Takeda | 123/564 |
| 5,168,839 | A | * | 12/1992 | Hitomi et al. | 123/184.42 |
| 5,190,016 | A | * | 3/1993 | Takeda | 123/564 |
| 6,148,794 | A | * | 11/2000 | Tsuzuku et al. | 123/406.5 |
| 6,634,344 | B2 | * | 10/2003 | Stretch | 123/559.3 |

FOREIGN PATENT DOCUMENTS

| | | | | | |
|---|---|---|---|---|---|
| JP | 02-024282 | | | 1/1990 | |
| JP | 3-65822 | | | 6/1991 | |
| JP | 04237826 | A | * | 8/1992 | F02B 33/00 |
| JP | 06-010681 | | | 1/1994 | |
| JP | 08-177634 | | | 7/1996 | |
| JP | 2005-337102 | | | 12/2005 | |

* cited by examiner

ENGINE SUPERCHARGING DEVICE

CROSS REFERENCE TO THE RELATED APPLICATION

This application is a continuation application, under 35 U.S.C §111(a) of international application No. PCT/JP2010/067835, filed Oct. 12, 2010, which claims priority to Japanese patent application No. 2009-236996, filed Oct. 14, 2009, the entire disclosure of which is herein incorporated by reference as a part of this application.

BACKGROUND OF THE INVENTION

1. Field of the Invention

The present invention relates to a supercharging device for compressing and forcibly supplying air to a combustion engine.

2. Description of Related Art

By way of example, in a motorcycle having a combustion engine equipped with a supercharger, a problem arises in efficiently arranging the supercharger, the air cleaner, the intake chamber and so on within a limited space available around the combustion engine. In view of this, the patent document 1 listed below suggests to position the carburetor and the air cleaner rearwardly of the forwardly tilted engine cylinder in a fashion juxtaposed relative to each other in a direction longitudinally of the motorcycle, to fluidly connect the air cleaner and the carburetor with each other through a suction passage and to place the supercharger in a space between the carburetor and the air cleaner.

[Prior Art Literature]

[Patent Document] JP Laid-open Patent Publication No. H02-24282

According to the patent document 1 listed above, the space delimited between the carburetor and the air cleaner is utilized as a space for accommodating the supercharger and therefore, the supercharger can be reasonably arranged around the combustion engine with no problem. However, in this system disclosed in the patent document 1, an intake chamber (surge tank) is disposed on a discharge side of the supercharger and the intake chamber and the air cleaner are communicated with each other through a bypass passage, with a relief valve being disposed on the bypass passage for the discharge of a supercharged pressure therethrough. For this reason, a space for accommodating the bypass passage must be made available and therefore, the space cannot be said as efficiently utilized. Also, since the carbureter, the intake chamber and the air cleaner are disposed rearwardly of the engine cylinder in the order specified, an intake system unit, composed of those devices, tends to become bulky in a direction longitudinally of the motorcycle.

SUMMARY OF THE INVENTION

The present invention has been devised to substantially eliminate the problems and inconveniences inherent in the system and is intended to provide a supercharging device for a combustion engine, component parts of which can be efficiently arranged within a limited space available around the combustion engine.

In order to accomplish the foregoing object, the present invention provides a supercharging device for a combustion engine, which includes a supercharger for pressurizing an air to be supplied towards the combustion engine, an air cleaner for purifying an ambient air, a purified air supply passage for supplying a purified air from the air cleaner towards the supercharger, a supercharged air passage for supplying the pressurized air from the supercharger towards an intake passage of the combustion engine, and a relief valve having a discharged port portion and operable to adjust an air pressure within the supercharged air supply passage. In such case, the discharge port portion is accommodated within at least one of the air cleaner and the purified air supply passage.

According to the structure, since the discharge port portion of the relief valve is accommodated within at least one of the air cleaner and the purified air supply passage, the use of any tube between the relief valve and either the air cleaner or the purified air supply passage can be dispensed with and as a result thereof the space available around the combustion engine can be utilized efficiently.

In a preferred embodiment of the present invention, the engine may have a plurality of engine cylinders, in which case a downstream portion of the supercharged air passage is formed by an intake air chamber for supplying an intake air into a plurality of air intake passages of the plural engine cylinders and the relief valve is operable to adjust the air pressure within the intake air chamber.

In a preferred embodiment of the present invention, a rotary shaft of the engine may extend in a direction laterally of an engine body, and a casing for the air cleaner and the intake air chambers are preferably arranged above the engine body. In such case, the supercharger is preferably arranged below the casing for the air cleaner and the intake air chamber, and the purified air supply passage may be arranged at a location adjacent one lateral side of the engine body. In such case, and the supercharged air passage is preferably arranged at a location laterally intermediate of the engine body with respect to the purified air supply passage. Here, the term "engine body" referred to above shall be construed as meaning a portion of the combustion engine which includes a crankcase, a cylinder block, a cylinder head, a cylinder head cover and an oil pan and shall not be construed as including an air intake system, an exhaust system and a transmission. According to this structure, since the supercharged air passage and the air supply passage are juxtaposed laterally relative to each other, the space can be utilized further efficiently.

In another preferred embodiment of the present invention, an additional fuel supply device for supplying an additional fuel towards an inlet of the air intake passage may be mounted on the intake air chamber. The use of the additional fuel supply device is effective to lower the temperature of the air inside the intake air chamber through the injection of the additional fuel.

In a further preferred embodiment of the present invention, respective inlets of the intake passages leading to the associated engine cylinders may be arranged in a row extending in a predetermined direction, in which case relative to an outlet of the supercharged passage opening into the intake air chamber, the larger the distance from the outlet to the inlet of the air intake passage, the smaller the cross-sectional area of the passage, or the passage sectional area, at a portion where the inlet of the air intake passage confronts within the intake air chamber. Here, the wording "a portion where the inlet of the air intake passage confronts" referred to above is intended to mean a portion contained in the imaginary plane containing an axis of the inlet of the air intake passage and lying perpendicular to the predetermined direction. According to this structure, the amount of air flowing gradually decreases as it goes away from the outlet of the supercharged air passage and, therefore, the air flow amount and the passage sectional area becomes balanced, facilitating a smooth flow of the air. Also, since the passage sectional area is small at a location away from the outlet of the supercharged air passage, the purified air supply passage, for example, can be arranged in a space made available as a result of reduction of the passage sectional area.

Also, in the supercharging device for the engine according to the present invention, the engine is mounted on a motorcycle, and at least one of the air cleaner and the purified air supply passage preferably covers an area above at least a portion of the supercharged air passage. According to this structure, it is possible to easily accommodate the outlet of the relief valve, provided in the supercharged air passage, within the purified air supply passage or the air cleaner thereabove.

In a still further preferred embodiment of the present invention, a transmission may be arranged rearwardly of the engine body and the supercharger is arranged rearwardly of the forwardly tilted cylinder block, in which case the intake air chamber is arranged above the supercharger and the air cleaner is arranged above the cylinder block. According to this structure, the supercharger and the intake air chamber can be arranged within the dead space available rearwardly and above the forwardly tilted cylinder block, respectively.

Where the supercharger is arranged rearwardly of the cylinder block, the supercharger is preferably driven by a rotary shaft of the engine through a chain. According to this structure, since the supercharger becomes proximate to the rotary shaft of the engine, the chain suffices to have a small length Where the intake air chamber is employed, the air cleaner preferably covers an area above a portion of the intake air chamber and the relief valve is arranged in that portion. According to this structure, the relief valve can be easily connected with the air cleaner and the intake air chamber.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter, preferred embodiments of the present invention will be described in detail with reference to the accompanying drawings. In particular, FIG. 1 illustrates a side view showing a motorcycle having a supercharger equipped combustion engine in accordance with a first preferred embodiment of the present invention.

Figure 1:
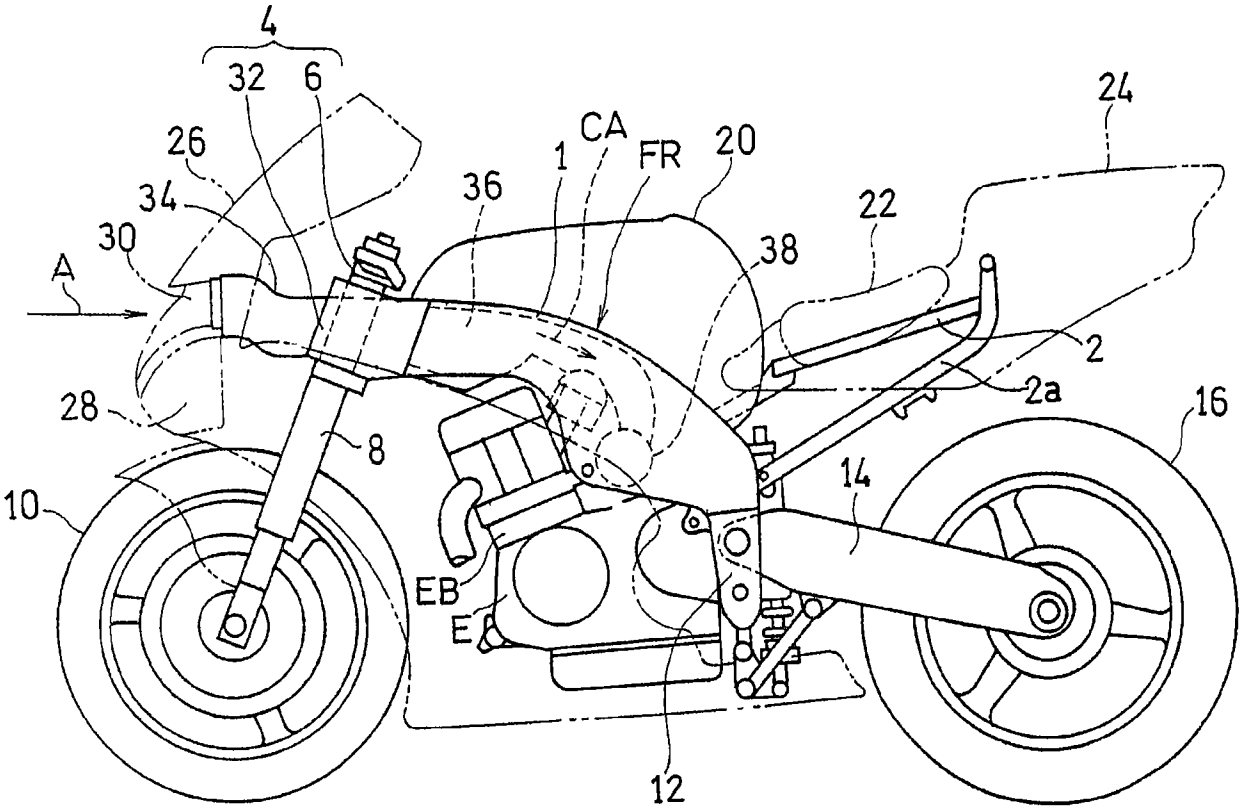
FIG. 1 is a side view of a motorcycle having a supercharger equipped combustion engine in accordance with a first preferred embodiment of the present invention.

The motorcycle shown in FIG. 1 has a motorcycle frame structure FR made up of a front frame portion including a main frame 1, and a rear frame portion including seat rail assembly 2 and a reinforcement rail assembly 2*a*. The main frame 1 has a front end portion formed integrally with a head block 4 with which a head tube 6 is formed integrally, and a front fork 8 is pivotally supported by the head tube 6 through a steering shaft (not shown), with a front wheel 10 rotatably supported by the front fork 8 in any known manner. On the other hand, a swingarm bracket 12 is provided in a rear end portion of the main frame 1, which is a lower intermediate portion of the motorcycle frame structure FR, and a swingarm 14 is supported by the swingarm bracket 12 for pivotal movement up and down in any known manner, with a rear wheel 16 rotatably supported by the swingarm 14.

A motorcycle combustion engine E, which may be, for example, a four-stroke cylinder combustion engine, is mounted on the lower intermediate portion of the motorcycle frame structure FR at a location forwardly of the swingarm bracket 12 with respect to the direction of forward travel of the motorcycle, so that the rear wheel 16 can be driven by the combustion engine E through an endless chain (not shown), also in any known manner. A steering handlebar (not shown) for steering the motorcycle is mounted on an upper end portion of the front fork 8 for rotation together therewith.

A fuel tank 20 is mounted atop the main frame 1 and a driver's seat 22 and a fellow passenger's seat 24 are mounted on the seat rail assembly 2. Also, a fairing 26 made of a resinous material is mounted on the front portion of the motorcycle frame structure FR so as to enclose a forward region of the motorcycle ranging from an area forwardly of an upper end of the front fork 8 to opposite side areas of the front portion of the motorcycle. This fairing 26 has a headlight unit 28 mounted thereon and also has at least one air intake opening 30 defined above the headlight unit 28 for introduction of an external air inwardly towards the combustion engine E.

The head block 4 referred to above is in the form of a casting including an intake duct 32, having a front end opening and the head tube 6, both formed integrally therewith. A ram duct unit 34 has a rear end portion fluidly connected with a front end portion of the intake duct 32 and is connected with the head block 4 with the front end opening thereof aligned with the air intake opening 30 in the fairing 26. An air cleaner 36 is fluidly connected with a rear end portion of the head block 4. Accordingly, the incoming air A, during the travel of the motorcycle, flows into the air intake opening 30 and then further flows through the ram duct unit 34 and the intake duct 32 to the air cleaner 36, where the air so introduced is purified to provide a purified air CA. The purified air CA is subsequently introduced into a supercharger 38, as will be described later, where the purified air CA is pressurized before it is subsequently introduced into the combustion engine. It is to be noted that although the use has been made of the ram duct unit 34 in the embodiment now under discussion, it may be dispensed with if so desired.

Figure 2:
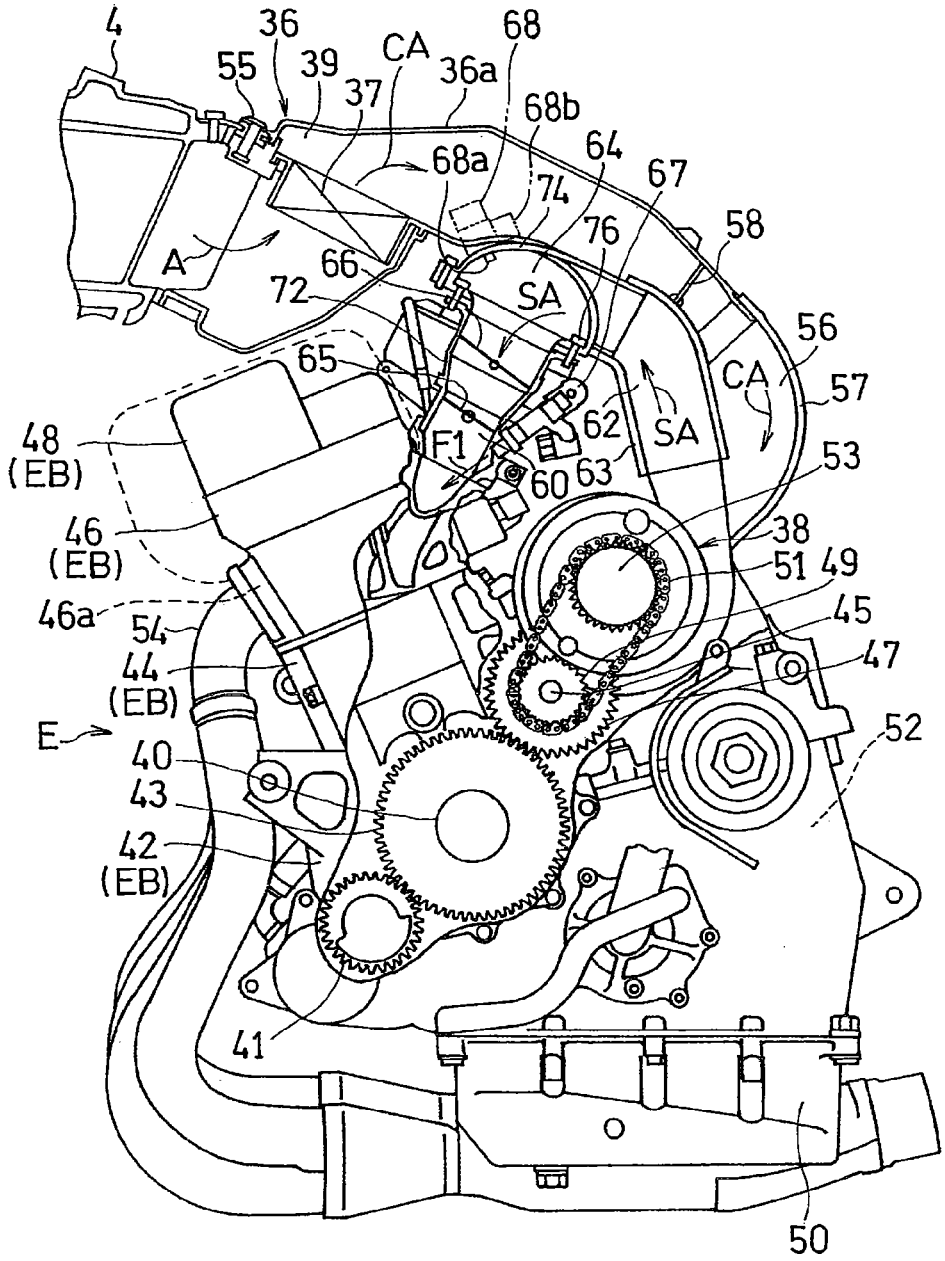
FIG. 2 is a side view, with a portion shown in section, of the combustion engine shown in FIG. 1.

As shown in FIG. 2 showing a side view of the combustion engine E, a crankshaft 40, which is a rotary shaft of the combustion engine E, extends in a direction transverse to an engine body EB or in a direction widthwise of the motorcycle. The engine body EB includes a crankcase 42 for supporting the crankshaft 40, a cylinder block 44 rigidly connected with an upper portion of the crankcase 42 so as to tilt forwards with respect to the direction of travel of the motorcycle, a cylinder head 46 rigidly mounted on the cylinder block 44, a cylinder head cover 48 for covering the cylinder head 46 and an oil pan 50 connected with a lower portion of the crankcase 42. A motorcycle transmission 52 is positioned rearwardly of the engine body EB.

The crankshaft 40 is provided with a balancer gear 43 mounted thereon for rotation together therewith, which gear 43 is used to drive a balancer 41 having an axis extending substantially parallel to the crankshaft 40. A gear carrier shaft 45, which is a kind of an idle shaft, is disposed on one side of the crankshaft 40 remote from the balancer 41 and is rotatable in unison with the crankshaft 40 when a drive gear 47 provided for rotation together with the gear carrier shaft 45 is meshed with a balancer gear 43. The gear carrier shaft 45 is formed with a sprocket 49 for transmitting a rotational force of the crankshaft 40 to a drive gear shaft 53 of the supercharger 38 through an endless chain 51. It is, however, to be noted that the manner of driving the supercharger 38 may not be necessarily limited to that described above.

The cylinder head 46 has four exhaust ports 46*a* defined therein and those exhaust ports 46*a* are fluidly connected with respective exhaust pipes 54. The four exhaust pipes 54, after having extended forwardly of the engine body EB, are merged together at a location beneath the engine body EB and then fluidly connected with a muffler (not shown) disposed rearwardly of the motorcycle. Those exhaust pipes 54 and the muffler altogether form an exhaust system.

A casing 36*a* for the air cleaner 36 is disposed above the cylinder head cover 48 of the engine body EB and secured to the head block 4 by means of screw members 55. The supercharger 38 referred to previously is disposed beneath the air cleaner 36 and, more specifically rearwardly of the forwardly tilted cylinder block 44 and between the air cleaner 36 and both of the engine body EB and the transmission 52. Accordingly, the supercharger 38 is in position to approach the crankshaft 40 and, therefore, the endless chain 51 trained between the sprocket 49, drivingly connected with the crankshaft 40, and the drive gear shaft 53 of the supercharger 38 has a small length. Both of the air cleaner 36 and the supercharger 38 are fluidly connected with each other through a purified air supply passage 56, and the purified air CA having passed through a filter element 37 in the air cleaner 36 is supplied from a purified air chamber 39, which is a clean side or a downstream side of the filter element 37, to the supercharger 38 through the purified air supply passage 56. The purified air supply passage 56 is formed by an air tube 57 and an air flow control valve 58 is disposed within this air tube 57 for controlling the amount of the purified air CA then flowing towards the supercharger 38 through the purified air supply passage 56.

A supercharged air passage 62 for supplying a supercharged air SA, supercharged by the supercharger 38, towards four air intake passages 60 of the four-stroke cylinder combustion engine E through a single intake air chamber 64 is fluidly connected with a discharge port side of the supercharger 38. The supercharged air passage 62 is formed by a supercharged air tube 63. The intake air chamber 64 is disposed above the engine body EB and, more specifically, above both of the cylinder head 46 and the supercharger 38 and below the air cleaner 36 and is fluidly connected with a downstream end of the supercharged air passage 62 with respect to the direction of flow of the supercharged air SA towards the combustion engine E. The intake air chamber 64 supplies the supercharged air SA to the air intake passages 60.

Each of air intake passages 60 is formed in a throttle body 72 fitted to the cylinder head 46, and this throttle body 72 is provided with a throttle valve 66 for adjusting the amount of intake air, a choke valve 65 for selectively opening and closing the respective air intake passage 60 and a fuel injector 67 for injecting a fuel F1. The throttle body 72 has an upstream end, to which a chamber casing 74 defining the intake air chamber 64 is secured by means of screw members 76. The throttle valve 66 and the fuel injector 67, together with the air flow control valve 58, are controlled by an electronic control unit ECU.

Figure 3:
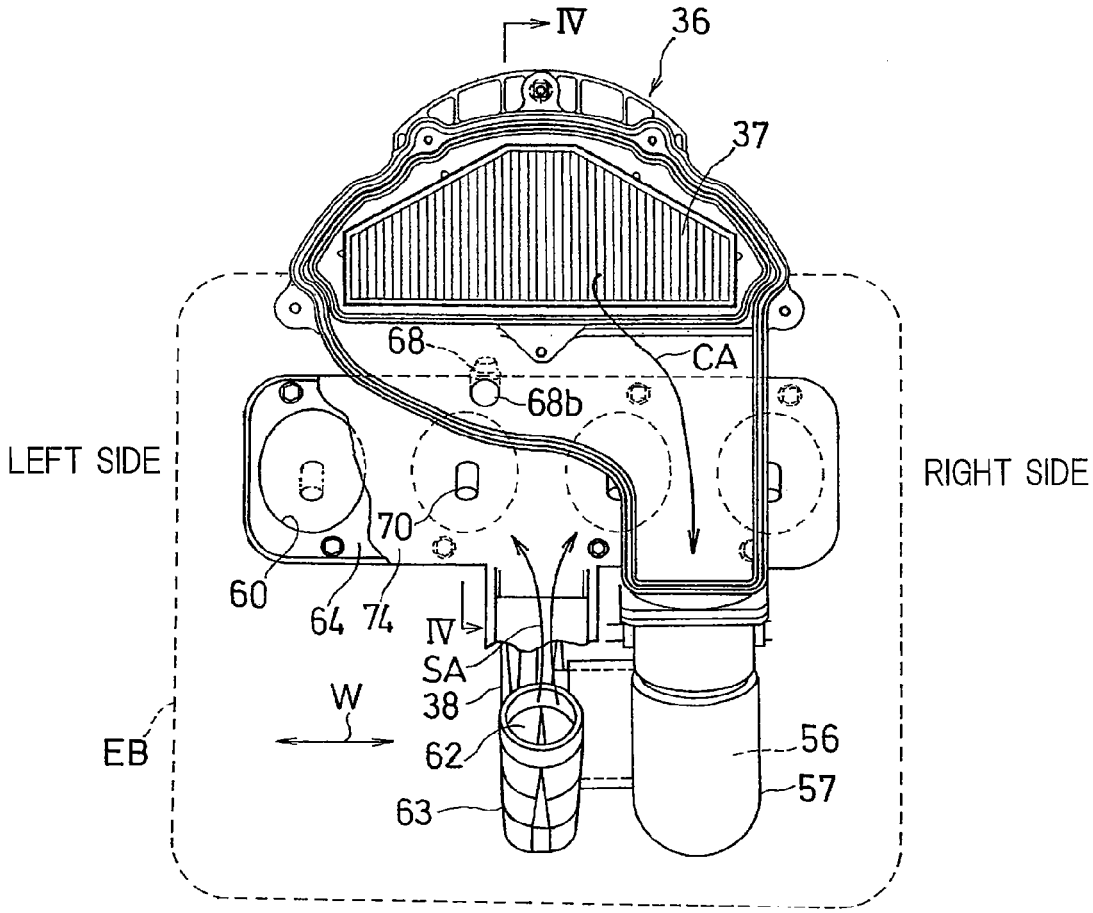
FIG. 3 is a top plan view showing an air intake system of the combustion engine.

As best shown in FIG. 3, which illustrates a top plan view of an air intake system, the purified air supply passage 56 is disposed on a right side of the engine body EB, which is one side of the engine body EB, the supercharged air passage 62 is disposed at a location closer to a substantially intermediate point of the engine body EB with respect to the widthwise direction of the engine body EB, or the widthwise direction of the motorcycle, than the purified air supply passage 56, and the supercharger 38 is disposed at a location intermediate of the engine body EB with respect to the widthwise direction of the engine body EB. The air cleaner 36 referred to previously encloses an area upwardly of a portion of the intake air chamber 64 defining a downward portion of the supercharged air passage 62. Although in the illustrated embodiment now under discussion, the air cleaner 36 encloses a substantially half of the intake air chamber 64, arrangement may be so made that at least one of the air cleaner 36 and the purified air supply passage 56 encloses at least a portion of the intake air chamber 64.

Figure 4:
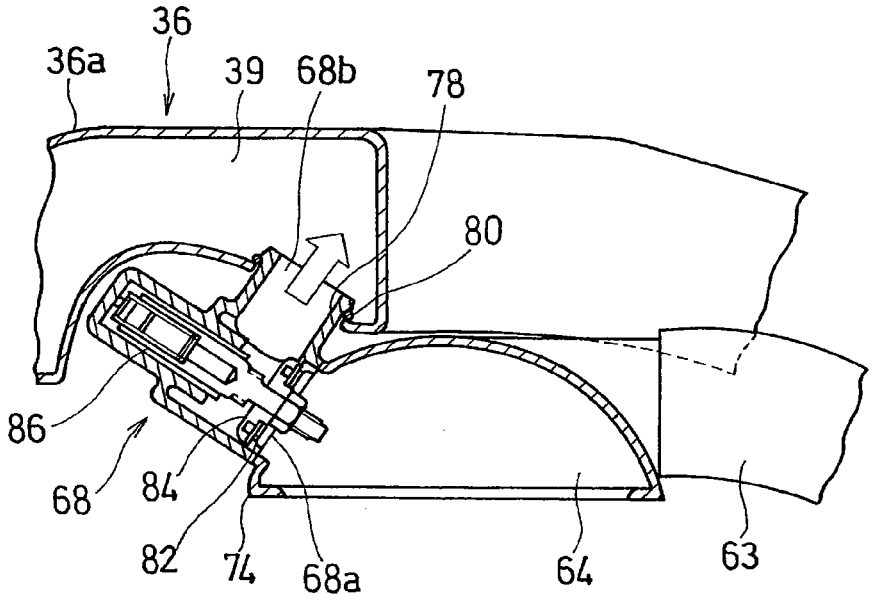
FIG. 4 is a sectional view showing a portion of the combustion engine in the vicinity of a relief valve employed in the engine intake system shown in FIG. 3.

The intake air chamber 64 shown in FIG. 2 is provided with a relief valve 68 for adjusting the air pressure inside the intake air chamber 64. This relief valve 68 is disposed in that portion of the intake air chamber 64, which is enclosed by the air cleaner 36. Accordingly, it is easy to fluidly connect the relief valve 68 with both of the intake air chamber 64 and the air cleaner 36. The relief valve 68 is removably fitted to a chamber casing 74 of the intake air chamber 64 by means of a fastening member (not shown), as shown in FIG. 4, with a pressure sensitive portion 68*a* thereof confronting the intake air chamber 64. The relief valve 68 has a discharge port portion 68*b* accommodated within the air cleaner 36, and this relief valve 68 opens, when the pressure inside the intake air chamber 64 attains a predetermined value, to relieve the air within the chamber 64 into the air cleaner 36. An interface between the discharge port portion 68*b* and an insertion hole 78 in the cleaner casing 36*a*, in which the discharge port portion 68*b* is inserted, is sealed by a sealing member 80 such as, for example, an O-ring.

The relief valve 68 has an annular valve seat 82 and a valve body 84, and the valve body 84 is normally urged against the valve seat 82 by a spring force of a spring member 86. When the pressure inside the intake air chamber 64 attains a value equal to or higher than the predetermined value, the valve body 84 moves away from the valve seat 82 against the spring force of the spring member 86 to communicate the intake air chamber 64 with the purified air chamber 39 of the air cleaner 36 to thereby relieve the high pressure.

Although in the embodiment now under discussion, the relief valve 68 is utilized so that it can be actuated by the pressure inside the intake air chamber 64, the pressure sensitive portion 68*a* of the relief valve 68 may be so disposed as to confront the supercharged air passage 62 so that the relief valve 68 can be actuated by the pressure inside the supercharged air passage 62. Also, the discharge port portion 68*b* may be accommodated within the purified air supply passage 56, not within the air cleaner 36 such as shown and described. Moreover, a top fuel injector 70, which is an additional fuel supply device for supplying an additional fuel F2 from a side upstream of the air intake passages 60 towards an inlet of each of the air intake passages 60, is mounted on the intake air chamber 64. The air cleaner 36, the purified air supply passage 56, the supercharger 38, the supercharged air passage 62, the intake air chamber 64 and the throttle body 72 cooperate with each other to form the intake system.

Figure 5:
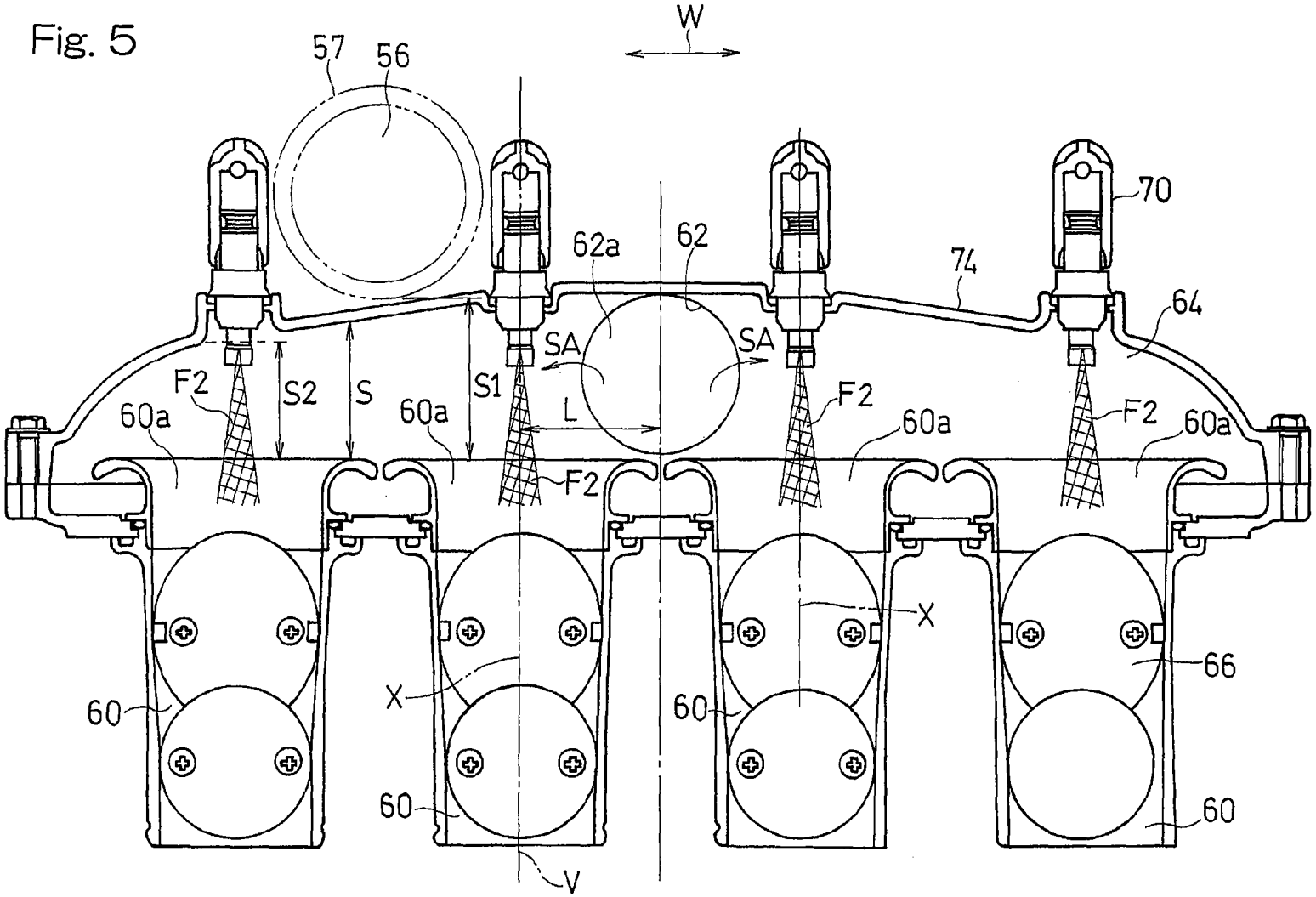
FIG. 5 is a sectional view showing an intake air chamber of the engine intake system.

Referring now to FIG. 5, the air intake passages 60 communicated respectively with engine cylinders have respective inlets 60*a* arranged in a row substantially parallel to the widthwise direction W of the motorcycle and fluidly connected with the intake air chamber 64. At an intermediate portion of the intake air chamber 64 with respect to the motorcycle widthwise direction W, an outlet 62*a* of the supercharged air passage 62 opens into the intake air chamber 64. The chamber casing 74 has an inner surface configuration smoothly changing from the intermediate portion thereof towards opposite side portions thereof so that the flow passage area S within the intake air chamber 64, that is, the passage sectional area within the intake air chamber 64, which is perpendicular to the direction of flow of the supercharged air SA within the intake air chamber 64, becomes small as the distance L between the geometric center of the outlet 62*a* of the supercharged air passage 62 and an axis X of each of the inlet 60*a* of the respective air intake passage 60 increases. Accordingly, the flow passage area S1 at a portion where the inlets 60*a* of two of the air intake passages 60 which are positioned adjacent the intermediate point of the intake air chamber 64 confront, is greater than the flow passage area S2 at a portion where the remaining two air intake passages 60 remote from the intermediate point of the intake air chamber 64 confront. The term "the portion where the inlets 60*a* of the air intake passages 60 confront" means spaces communicated with those inlets 60*a* and a portion encompassed within the imaginary plane V containing the axis X and lying perpendicular to the motorcycle widthwise direction W, the direction in which the inlets 60*a* are lined up.

In the vicinity of the intermediate point of the intake air chamber 64 with respect to the motorcycle widthwise direction W, the supercharged air SA supplied from the outlet 62*a* of the supercharged air passage 62 to both of the two air intake passages 60 on a left or right side flows, but in the vicinity of the opposite side portions with respect to the motorcycle widthwise direction W, the supercharged air SA supplied to only one of the two air intake passages 60 flows. Accordingly, be setting the flow passage area S1 adjacent the intermediate point being greater than the flow passage area S2 at the opposite side portions, the amount of flow of the supercharged air SA and each of the flow passage area S1 adjacent the intermediate point and the flow passage area S2 adjacent the opposite side portions are balanced with each other. Also, the purified air supply passage 56 is disposed in a dead space above the intake air chamber 64, which dead space has been made by narrowing the flow passage area S2.

Hereinafter, the operation of the air intake system will be described. When and so long as the crankshaft 40 of the combustion engine E is driven, the supercharger 38 drivingly coupled with the combustion engine E is also driven. Since the ram duct unit 34 (best shown in FIG. 1) extending forwardly of the motorcycle is fluidly connected with the casing 36*a* of the air cleaner 36 on one side upstream of the supercharger 38, the supercharger 38 is assisted by the air pressure of the ram air A and, therefore, a further increased supercharged pressure can be obtained. The air flow control valve 58, provided in the purified air supply passage 56, is controlled by the electronic control unit ECU and the amount of air, that is, the supercharged pressure to be supplied to the supercharger 38 is regulated.

The supercharged air SA pressurized by the supercharger 38 is supplied to the intake air chamber 64 through the supercharged air passage 62. The supercharged air SA so supplied to the intake air chamber 64 is mixed with the fuel F1, supplied from the fuel injector 67, during the flow thereof through the air intake passages 60, and the resultant air-fuel mixtures are supplied towards the engine cylinder block 44. At this time, in response to a command from a throttle grip on the handlebar, the electronic control unit ECU controls the opening of the air intake throttle valve 66 in each air intake passage 60 or the opening of the air flow control valve 58 and the amount of fuel to be injected through the fuel injector 67.

At a high load, high speed region, in addition to the fuel injector 67, the fuel F2 is also supplied into the air intake passages 60 from the associated top fuel injectors 70 provided in the intake air chamber 64 as shown in FIG. 5. At this time, such an advantage can be appreciated that the high temperature supercharged air SA, fed from the supercharger 38 then driven at a high speed, is cooled by the fuels F2 injected from the associated top fuel injectors 70.

Also, when the supercharged pressure within the intake air chamber 64 attains the value equal to or higher than the predetermined value, the relief valve 68 provided in the intake air chamber 64 as shown in FIG. 4 are actuated to relieve the supercharged air SA to the purified air chamber 39, which is on the downstream side of the filter element 37 of the air cleaner 36, that is, the clean side thereof, thereby preventing an excessive increase of the supercharged pressure.

According to the embodiment hereinabove described, the discharge port portion 68*b* of the relief valve 68 provided in the intake air chamber 64 is accommodated in the air cleaner 36 and, therefore, the use of any communicating tube between the relief valve 68 and the air cleaner 36 is dispensed with and the space available around the combustion engine E shown in FIG. 2 can be utilized efficiently.

Also, the air cleaner 36 is positioned proximate to the intake air chamber 64 while covering an area above a portion of the intake air chamber 64 and therefore, the discharge port portion 68*b* of the relief valve 68 for adjusting the pressure inside the intake air chamber 64 can be easily accommodated within the air cleaner 36 above it.

Since the purified air supply passage 56 best shown in FIG. 3 is positioned on the right side, which is one lateral side of the engine body EB, and the supercharged air passage 62 is positioned at that location closer to the substantially intermediate point of the engine body EB with respect to the widthwise direction of the engine body EB than the purified air supply passage 56, the supercharged air passage 62 and the purified air supply passage 56 are juxtaposed laterally relative to each other and the space can therefore be utilized further efficiently.

The top fuel injector 70 for supplying the additional fuel F2 towards the inlet 60*a* of each of the air intake passages 60 best shown in FIG. 5 is mounted on the intake air chamber 64 and, therefore, injection of the additional fuel F2 is effective to suppress an increase of the temperature of the air within the intake air chamber 64 to thereby suppress an undesirable deterioration of, for example, resin-made portions and rubber components of the air intake passages 60 and the intake throttle valves 66 under the influence of the elevated temperature.

Moreover, since the flow passage area S of the intake air chamber 64 is so designed that the flow passage area S1 at that portion, where the inlets 60*a* of the air intake passages 60 which are positioned adjacent the intermediate point of the intake air chamber 64 confront, may be great and the flow passage area S2 of that portion, where the air intake passages 60 remote from the intermediate point of the intake air chamber 64 confront, may be small, the amount of flow of the supercharged air SA and each of the flow passage areas S1 and S2 become balanced with each other and the flow of the supercharged air SA becomes smooth with the suction resistance reduced consequently. In addition, since the height of opposite side portion of the intake air chamber 64 becomes small and the purified air supply passage 64 is disposed within the dead space, the space available around the combustion engine E can be utilized further efficiently.

Furthermore, since the transmission 52 is disposed rearwardly of the engine body EB, the supercharger 38 is disposed rearwardly of the forwardly tilted cylinder block 44 of the engine body EB, the intake air chamber 64 is disposed above the supercharger 38, and the air cleaner 36 is disposed above the cylinder head cover 48, the air cleaner 36, the supercharger 38 and the intake air chamber 64 are arranged in the dead space available rearwardly and above the forwardly tilted cylinder block 44 and, hence, the space around the combustion engine E can be utilized efficiently.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, the supercharged air SA, the temperature of which is increased in the supercharger 38, may be cooled by an intercooler and/or the supercharger 38 may be driven by means of a train of gears, not by means of the endless chain 51.

Accordingly, such changes and modifications are, unless they depart from the scope of the present invention as delivered from the claims annexed hereto, to be construed as included therein.

REFERENCE NUMERALS

38 . . . Supercharger
36 . . . Air cleaner
36*a* . . . Casing
44 . . . Cylinder block
52 . . . Transmission
56 . . . Purified air supply passage
60 . . . Air intake passage
60*a* . . . Inlet of air intake passage
62 . . . Supercharged air passage
62*a* . . . Outlet of supercharged air passage
64 . . . Intake air chamber
68 . . . Relief valve
68*b* . . . Discharge port portion of relief valve
70 . . . Top fuel injector (Additional fuel supply device)
E . . . Combustion engine
EB . . . Engine body
S . . . Flow passage area (Passage sectional area)

What is claimed is:

1. A supercharging device for an engine, which comprises:
a supercharger for pressurizing air to be introduced into the engine;
an air cleaner for purifying an ambient air;
a purified air supply passage for supplying a purified air from the air cleaner towards the supercharger;
a supercharged air passage for supplying the pressurized air from the supercharger towards the engine; and
a relief valve for adjusting an air pressure within the supercharged air passage,
in which the relief valve is disposed in a portion of the supercharged air passage, which portion is enclosed by at least one of the air cleaner and the purified air supply passage, and
in which a discharge port portion of the relief valve is accommodated within at least one of the air cleaner and the purified air supply passage for releasing supercharged air above a predetermined pressure.

2. The supercharging device for the engine as claimed in claim 1, in which the engine has a plurality of engine cylinders;
further comprising an intake air chamber, forming a downstream portion of the supercharged air passage, for supplying an intake air into a plurality of air intake passages of the plural engine cylinders,
wherein the relief valve is operable to adjust the air pressure within the intake air chamber.

3. The supercharging device for the engine as claimed in claim 2, in which:
a rotary shaft of the engine extends in a direction laterally of an engine body;
a casing for the air cleaner and the intake air chamber are arranged above the engine body;
the supercharger is arranged below the casing for the air cleaner and the intake air chamber;
the purified air supply passage is arranged at a location adjacent one lateral side of the engine body; and
the supercharged air passage is arranged at a location laterally intermediate of the engine body with respect to the purified air supply passage.

4. The supercharging device for the engine as claimed in claim 2, further comprising an additional fuel supply device for supplying an additional fuel towards an inlet of the air intake passage, the additional fuel supply being mounted on the intake air chamber.

5. The supercharging device for the engine as claimed in claim 2, in which:
respective inlets of the intake passages leading to the associated engine cylinders are arranged in a row extending in a predetermined direction; and
relative to an outlet of the supercharged passage opening into the intake air chamber, the larger the distance from the outlet to the inlet of the air intake passage, the smaller the passage cross sectional area at a portion where the inlet of the air intake passage confronts within the intake air chamber to balance the amount of supercharged air flow for each of the engine cylinders.

6. The supercharging device for the engine as claimed in claim 1, in which the engine is adapted to be mounted on a motorcycle, and at least one of the air cleaner and the purified air supply passage covers an area above at least a portion of the supercharged air passage.

7. The supercharging device for the engine as claimed in claim 6, in which a transmission is arranged rearwardly of the engine body and the supercharger is arranged rearwardly of the forwardly tilted cylinder block, and
the intake air chamber is arranged above the supercharger and the air cleaner is arranged above the cylinder block.

8. The supercharging device for the engine as claimed in claim 7, in which the supercharger is driven by a rotary shaft of the engine through a chain.

9. The supercharging device as claimed in claim 2, in which the air cleaner covers an area above a portion of the intake air chamber and the relief valve is arranged in that portion.

10. The supercharging device as claimed in claim 1, in which the air cleaner or the purified air supply passage and the supercharged air passage are arranged one above the other, and
the relief valve is arranged between the air cleaner or the purified air supply passage and the supercharged air passage with respect to a vertical direction.

11. The supercharging device as claimed in claim 1, in which a portion of the relief valve is accommodated within at least the air cleaner and the purified air supply passage.

12. In a motorcycle, the improvement of a supercharging device for a motorcycle engine, which comprises:

a supercharger, positioned rearwardly adjacent the engine, for pressurizing air to be introduced into the engine;

an air cleaner with a casing for purifying an ambient air;

a purified air supply passage for supplying a purified air from the air cleaner casing positioned above the engine and extending across the engine to the supercharger;

a supercharged air passage for supplying the pressurized air from the supercharger towards the engine; and a relief valve for adjusting an air pressure within the supercharged air passage, wherein the relief valve is in a direct fluid connection between a portion of the supercharged air passage and the air cleaner, in which a discharge port portion of the relief valve is accommodated within the casing of the air cleaner for releasing supercharged air above a predetermined pressure from the supercharged air passage.

* * * * *